United States Patent [19]

Smith

[11] 3,940,213

[45] Feb. 24, 1976

[54] DRIVE SYSTEM

[75] Inventor: Rymer H. Smith, Burgoon, Ohio

[73] Assignee: Wikel Manufacturing Co. Inc., Sandusky, Ohio

[22] Filed: Nov. 1, 1974

[21] Appl. No.: 519,837

[52] U.S. Cl. ..... 404/111; 180/66 R

[51] Int. Cl.[2] ..... E01C 19/18

[58] Field of Search ..... 404/111, 118; 239/146, 239/147; 180/66 R, 66 B

[56] References Cited

UNITED STATES PATENTS

| | | | |
|---|---|---|---|
| 858,422 | 7/1907 | Smales | 239/146 X |
| 3,183,803 | 5/1965 | Gierhart | 404/111 |
| 3,195,669 | 7/1965 | Court | 180/66 R |
| 3,283,675 | 11/1966 | Gifford | 404/111 |
| 3,533,336 | 10/1970 | Wikel | 404/111 |
| 3,724,583 | 4/1973 | Caldwell | 180/66 R |

*Primary Examiner*—Nile C. Byers

*Attorney, Agent, or Firm*—McGlynn and Milton

[57] ABSTRACT

A vehicle of the type for applying a coating to a surface such as applying a sealant to asphalt pavement, the vehicle including a body having a reservoir for storing and distributing a fluid, two driven wheels disposed in spaced-apart relationship along the longitudinal axis of the body and adapted for continuous engagement with a support surface, one of the driven wheels being dirigible, support wheels disposed laterally of the axis of the body and spaced from the dirigible driven wheel, and variable drive means for driving the driven wheels.

23 Claims, 5 Drawing Figures

DRIVE SYSTEM

This invention relates to a machine of the type for applying a coating to a surface, such as applying a sealant to asphalt pavement. Such machines are frequently called seal coaters or sealing applicators.

Such machines typically include a body having various tanks or compartments, one of which is a tank for storing the coating fluid and which includes means for dispensing the coating fluid from the storage tank. A spreader device is provided rearwardly of the coating fluid tank for spreading the coating fluid evenly over the surface. This spreader device is pivotally connected to the body to permit movement in a vertical direction to accommodate unlevel terrain and includes a hydraulically operated lift mechanism for removing or raising the spreader device from the operative position.

The body of heretofore known machines or vehicles of this type is supported by three wheels arranged in tricycle fashion. In other words, a dirigible wheel is disposed forwardly and centrally of the body and two axially aligned spaced-apart wheels are disposed rearwardly of the body, one on either side of the longitudinal axis thereof. In most cases, the front or dirigible wheel is driven by a suitable power source, such as a fluid motor and pump, to move the vehicle over a surface. The primary function of the rear wheels, therefore, is to support the rear of the body.

Problems have been encountered with the vehicle arrangement described above. Specifically, the front wheel must remain in frictional or driving engagement with the surface; however, when the vehicle travels up an incline, the weight is transferred to the rear wheels and the front wheel tends to lose traction. Obviously, this greatly impairs the operation of the vehicle.

One solution to this problem, which has been suggested, is to drive the rear wheels rather than the front wheel. This solution is unacceptable because when the vehicle is turned sharply, the rear wheel on the inside of the turn must have the capacity to move rearwardly while the rear wheel on the outside of the turn moves forwardly. For example, taking the most extreme case where the front wheel is turned 90° with respect to the longitudinal axis of the body, the body turns by pivoting about a point on the longitudinal axis between the two support wheels. To accomplish this movement, the inside wheel must move rearwardly while the outside wheel moves forwardly. In other words, the two support wheels must rotate in opposite directions. Differential gearing for axles is available which permits different rotational speeds of two wheel-supporting axles, but none permit one to rotate in a direction opposite to the other. Furthermore, attempting to drive each of the two support wheels independently would be extremely difficult if not impossible in a vehicle of this type.

It is, therefore, a primary purpose of the instant invention to provide a vehicle of the type referred to above which includes a second driven wheel disposed along the longitudinal axis of the body and generally between the two support wheels to permit operation of the vehicle on an incline while avoiding the steering problems noted above. Furthermore, the drive means for driving the two driven wheels includes compensating means responsive to the increase in the resistance to motion of one of the driven wheels occasioned by a difference in their respective rotational speeds for directing at least a portion of the motive energy away from the slower driven wheel.

Other objects and attendant advantages of the instant invention will be readily appreciated as the same becomes better understood by reference to the following detailed description when considered in connection with the accompanying drawings wherein.

Figure 1:
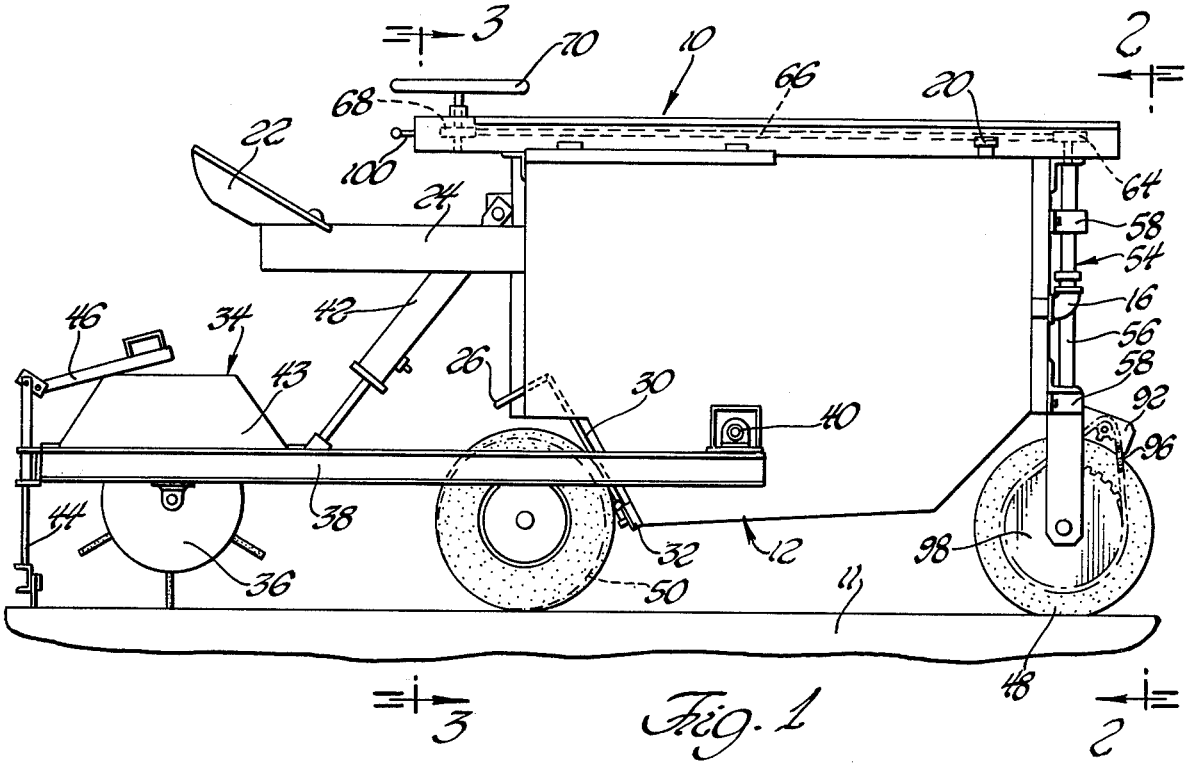
FIG. 1 is a side elevational view of a preferred embodiment of the instant invention.
Figure 2:
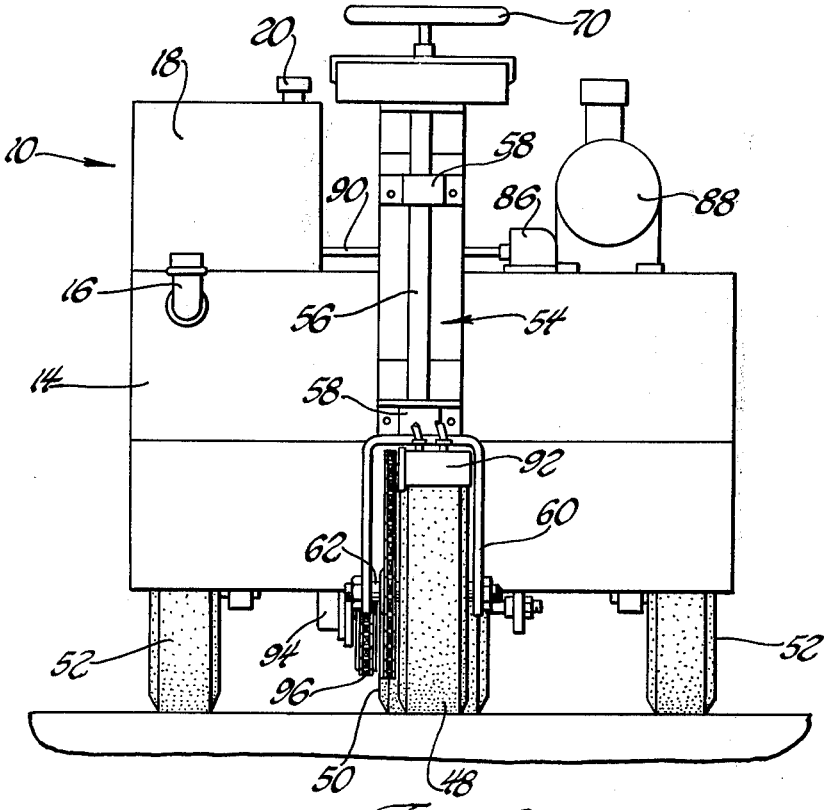
FIG. 2 is a front elevational view of the preferred embodiment of the instant invention taken generally along line 2—2 of FIG. 1.

Referring now to the drawings wherein like numerals indicate like or corresponding parts throughout the several views, a preferred embodiment of the asphalt sealing vehicle of the instant invention is generally shown at 10. The vehicle 10 is of the type for applying a coating to a surface 11, such as applying a sealant coating to asphalt pavement.

The vehicle 10 includes a body means generally indicated at 12. The body means 12 generally includes upper and lower extremities interconnected by opposite sides and front and rear ends. The body means 12 includes various tanks or compartments for storing fluids necessary to the operation of the vehicle. More specifically, a major portion of the body means 12 comprises reservoir means for storing and distributing the coating fluid. The body means 12 also includes a forwardly disposed tank 14 for storing water which is applied to the surface before the sealing coat. The tank 14 includes a suitable filling spigot 16 for refilling the tank 14 after the water is expended. The body means 12 also includes a tank 18 for storing hydraulic fluid, the purpose for which will be hereinafter described. The tank 18 also includes a suitable filling spigot 20.

The vehicle 10 also includes an operator seat 22 which is supported by the body means 12 through a suitable cantilever beam 24. Foot pedals 26 are pivotally mounted by means of a rod 28 on the body means 12 and are connected through suitable connecting links 30 to valves 32 which control the flow of coating fluid from the reservoir. In other words, the valves 32 open and close dispensing apertures 34 in the bottom of the reservoir for controlling the amount of coating fluid applied to the surface 11.

The vehicle 10 is also provided with a spreader device, generally shown at 34, which is adapted to spread the coating fluid evenly over the surface. The spreader device 34 generally includes a paddle wheel 36 rotatably supported on a shaft disposed between two beams 38. Each of the beams 38 is pivotally attached to the side of the body means 12, such as at 40. A hydraulically operated piston and cylinder device is disposed between the beams 38 and the body means 12 for moving the spreader device 34 between operative and inoperative positions with respect to the surface 11. The paddle wheel 36 is enclosed by a suitable cover or cowling 43. A manually operated scraper 44 is also provided at the rear of the paddle wheel 36 which is operated by a suitable handle 46.

The vehicle, as heretofore described, is disclosed in greater detail in U.S. Pat. No. 3,533,336 granted to David C. Wikel, which may be referred to for a greater understanding of the various specific components of the vehicle.

In accordance with the instant invention, the body means 12 is supported by two driven wheels 48 and 50 which are disposed in spaced-apart relationship along the longitudinal axis of the body means and is adapted for continuous engagement with the support surface 11. A pair of support wheels 52 are also provided which are disposed laterally of the longitudinal axis of the body means 12 and generally adjacent the driven wheel 50.

One of the driven wheels, driven wheel 48, is dirigibly supported adjacent the front end of the body means 12. For this purpose attachment means, generally indicated at 54, is provided for attaching the dirigible driven wheel 48 to the body means 12. The attachment means 54 includes a rotatable, generally vertical shaft member 56 which is rotatably secured to the body means 12 by a pair of brackets 58. A yoke member 60 is secured to the lower end of the shaft member 56 and supports an axle member 62 on which the dirigible wheel 48 is disposed. To allow steering of the dirigible wheel 48, the upper end of the shaft member 56 includes a chain sprocket 64 which is rotated by an endless loop chain 66. The chain 66 is operatively connected to a chain sprocket 68 rotated by a steering wheel 70 positioned in close proximity to the operator seat 22. Rotation of the steering wheel 70 by the operator causes rotation of the shaft member 56 and, consequently, the dirigible wheel 48.

Attachment means is provided for attaching the non-dirigible driven wheel 50 to the body means 12. The attachment means includes a pair of spaced-apart arm members 72 which are pivotally connected to the body means 12, as at 73. An axle member 74 is supported between the arm members 72 on which the wheel 50 is disposed. The pivotal connection of the arm members 72 permits vertical movement of the driven wheel 50 with respect to the body means 12. The attachment means also includes shock absorbing suspension means including a frame member 76 disposed over the driven wheel 50 and supported by the arm members 72. Resilient means comprising a pair of coil springs 78 are disposed between the cross member 80 of the frame member 76 and the underside of the body means 12 for providing shock absorbing suspension between driven wheel 50 and the body means 12.

Figure 3:
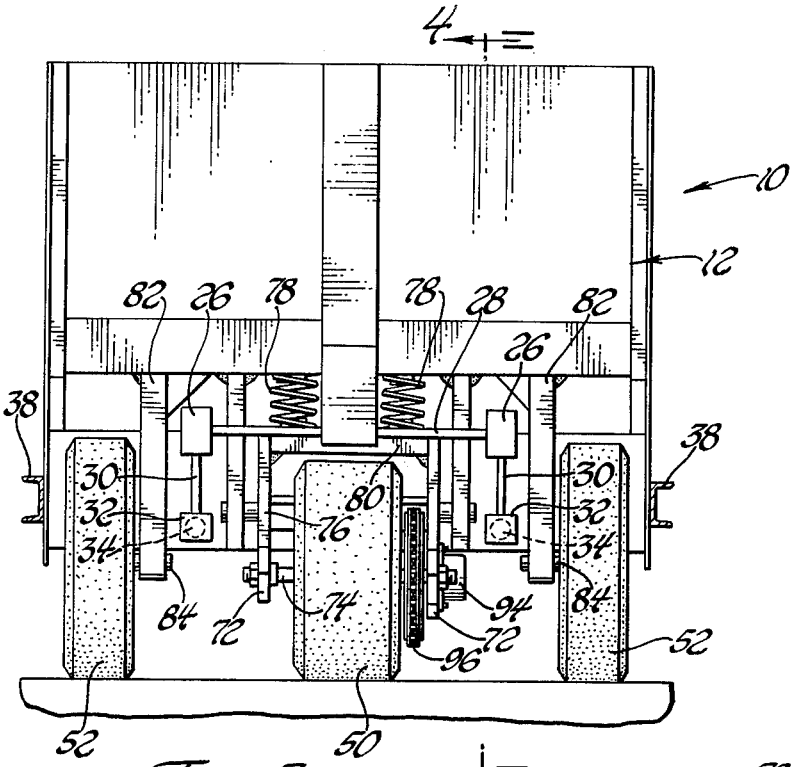
FIG. 3 is a cross-sectional view of the preferred embodiment of the instant invention taken generally along line 3—3 of FIG. 1.
Figure 4:
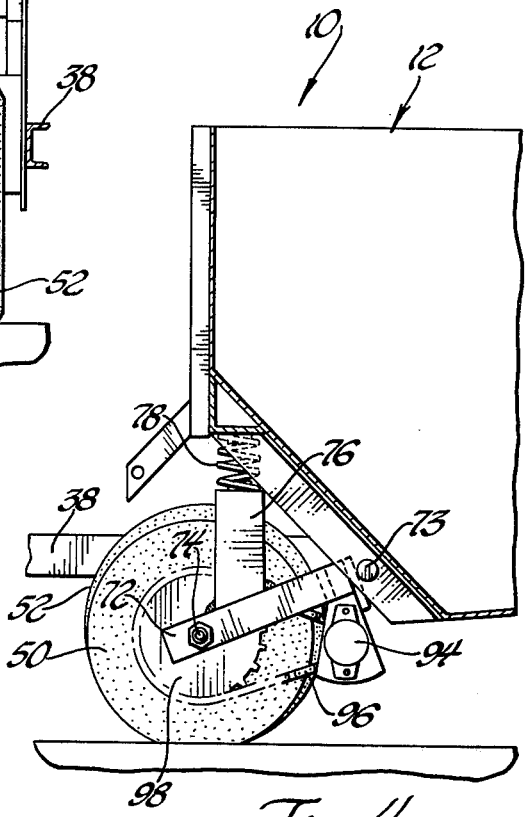
FIG. 4 is a cross-sectional view taken generally along line 4—4 of FIG. 3.

The support wheels 52 are disposed on each side of the non-dirigible driven wheel 50 and are spaced laterally therefrom, as shown in FIG. 3. Means for attaching the support wheels 52 through the body means 12 includes a pair of depending leg members 82 and an axle member 84 supported by each of said depending leg members 82. The support wheels 52 are mounted for rotation on the axle member 84 and are free to rotate independently of one another.

The vehicle 10 also includes drive means for driving the driven wheels 48 and 50. In the preferred embodiment of the vehicle 10, the drive means includes a fluid pump 86 which is powered by a gasoline engine 88. The fluid pump 86 is connected by line 90 to the hydraulic fluid reservoir 18 which functions as a source of hydraulic fluid. Each of the driven wheels 48 and 50 include a fluid motor 92 and 94 which are connected by suitable lines to the fluid pump 96. Each of the fluid motors 92 and 94 includes a drive pinion which engages an endless loop chain 96 for rotating a driven sprocket 98 attached to the corresponding driven wheel 48 or 50. Hydraulic fluid, under pressure, is supplied from the fluid pump 86 to drive the fluid motors 92 and 94 which, in turn, rotate the driven wheels 48 and 50 to move the vehicle 10 over the surface 11.

Suitable controls represented by a handle 100 in operative proximity to the operator seat 22 are provided for controlling the output of the gasoline engine 88 and, therefore, the fluid pump 86, and also for controlling a four-way valve for changing the direction of flow of the hydraulic fluid to reverse the direction of the fluid motors 92 and 94.

When the vehicle is traveling in a straight line, both driven wheels 48 and 50 have the same rotational velocity, assuming of course that they are both of the same diameter. If both wheels are not of the same diameter, the drive pinion and driven sprocket 98 are suitably arranged so that the speeds of both fluid motors 92 and 94 are the same when the vehicle is traveling along a straight path. For purposes of explanation, however, it is assumed that the two driven wheels 48 and 50 are of equal diameter. Under these conditions, when the dirigible driven wheel 48 is turned, it has a rotational velocity greater than the rotational velocity of the driven wheel 50 since the dirigible driven wheel 48 is traveling along a curved path having a greater radius of curvature. Consequently, the fluid motor 94 which drives the slower moving rear wheel 50, encounters increasingly greater resistance to motion as the difference in rotational speeds increases. Therefore, compensating means is provided which is responsive to the increase in resistance to motion of the fluid motor 94 occasioned by the difference in the respective rotational speeds of the driven wheels for directing at least a portion of the hydraulic fluid away from the fluid motor 94.

Figure 5:
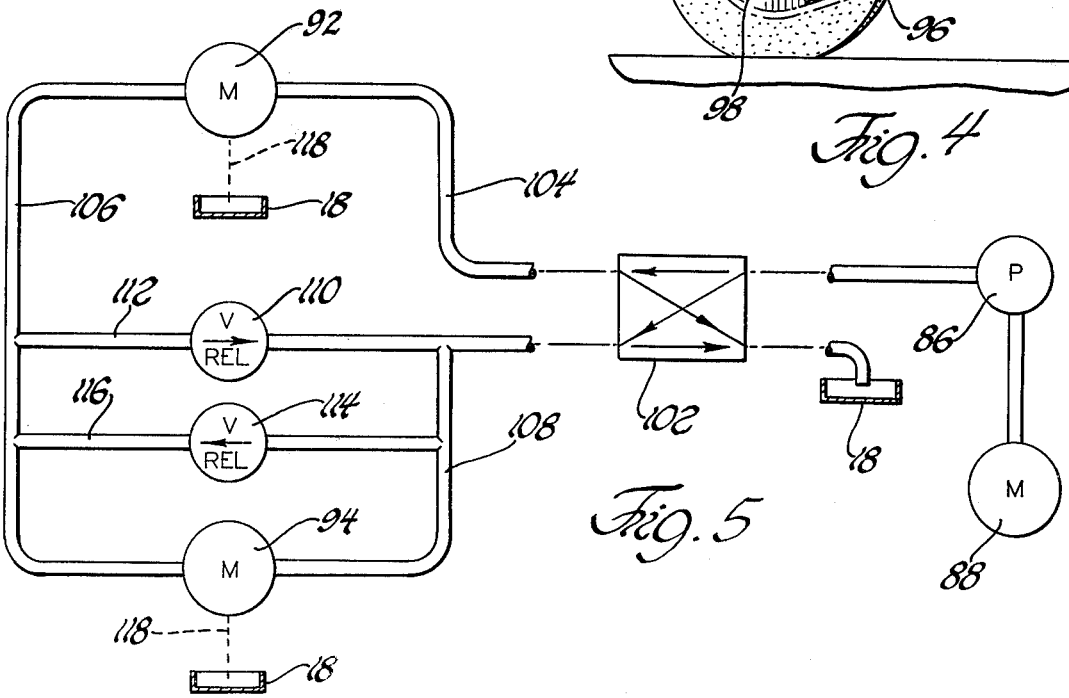
FIG. 5 is a schematic diagram showing the arrangement of components of the preferred embodiment of the instant invention.

By way of explanation, and referring to FIG. 5 which shows a schematic illustration of the drive means, the gasoline engine 88 is shown connected to the fluid pump 86 for driving the same. Hydraulic fluid from the fluid pump 86 is pumped through a four-way valve 102 and then through line 104 to the fluid motor 92 to drive the dirigible driven wheel 48. The hydraulic fluid then passes through line 106 to the fluid motor 94, associated with the rear driven wheel 50 to drive the same, and then through line 108 and four-way valve 102 and returns to the reservoir 18. The hydraulic fluid traveling in this direction, through the fluid motors 92 and 94, moves the vehicle 10 in a forward direction. When the vehicle 10 is moving in a straight line, both of the motors 92 and 94 operate at the same speed; however, when the dirigible wheel 48 is turned, the fluid motor 94, associated with the non-dirigible driven wheel 50, is forced to slow down since the driven wheel 50 is no longer capable of rotating at the same speed as driven wheel 48. Consequently, pressure builds up in line 106 since the volume of hydraulic fluid moving through fluid motor 92 is greater than the volume of hydraulic fluid moving through fluid motor 94. The compensating means referred to above includes a relief valve 110 disposed in a line 112 connecting line 106 with line 108. When the pressure in line 106 reaches a critical value, relief valve 110 opens allowing a portion of hydraulic fluid to bypass the slower fluid motor 94. It is noted that the fractional amount of hydraulic fluid allowed to pass through the relief valve 110 is proportional to the difference in the relative speeds of the two fluid motors 92 and 94. In this way, fluid motor 92 is capable of operating at a higher speed than fluid motor 94; however, some hydraulic fluid is supplied to fluid motor 94 to drive the same.

If the vehicle 10 is operated in the reverse direction, that is, for the purposes of backing up, the four-way valve 102 is activated by the control handle 100 to reverse the direction of flow of the hydraulic fluid from the fluid pump 86 to the fluid motors 92 and 94. More specifically, the hydraulic fluid from the fluid pump 86 travels through the four-way valve 102, line 108, fluid motor 94, line 106, fluid motor 92, line 104, and back through the four-way valve 102 to the reservoir 18. Similarly, compensating means is provided for accommodating the difference in the speeds of the fluid motors 92 and 94 during turns while the vehicle is backing up. Accordingly, a relief valve 114 is disposed in the line 116 between line 108 and line 106. During a turn and while the vehicle is moving in a rearward direction, the dirigible wheel 48 will have a rotational speed higher than the rotational speed of the driven wheel 50 associated with the fluid motor 94. Again, the speed of the fluid motor 94 will be retarded causing fluid pressure to build in line 108. When the pressure has reached a critical amount, relief valve 114 opens to permit a portion of the hydraulic fluid to pass from line 108 through line 116 to line 106 and then through fluid motor 92. Again it is noted that, in this manner, the fluid motors 92 and 94 may operate at different speeds to allow turning of the vehicle 10.

It is further noted that during a turn only a portion of hydraulic fluid is directed away from the slower moving fluid motor 94, except in the situation in which driven wheel 50 is absolutely stationary. Consequently, driving power is being simultaneously supplied to both of the driven wheels 48 and 50 at all times.

Both of the fluid motors 92 and 94 are provided with safety valves which open in the event that the fluid pressure within the respective fluid motor reaches an unsafe level. In other words, to prevent blowing the seals out of the fluid motors, safety valves are provided. The safety valves are connected to a line 118 which conducts the fluid to the reservoir 18.

As described above, the vehicle 10 is provided with a hydraulic drive system for driving the two driven wheels 48 and 50. Accordingly, the compensating means includes relief valves 110 and 114. It is contemplated that drive means other than a hydraulic system may be provided, for example, the fluid motors 92 and 94 may be replaced by electric motors and the fluid pump 86 may be replaced by a suitable generator. Again, compensating means is provided which is responsive to the increase in resistance to motion of one of the motors occasioned by a difference in the respective rotational speeds of the driven wheels for directing at least a portion of the motive energy away from the motor of the slower wheel.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described, yet remain within the scope of the depending claims.

The embodiments of the invention in which an exclusive property or privilege is claimed are defined as follows:

1. A vehicle of the type for applying a coating to a surface such as applying a sealant to asphalt pavement, said vehicle comprising: body means including reservoir means for storing and distributing a fluid, two driven wheels disposed in spaced-apart relationship along the longitudinal axis of said body means and adapted for continuous engagement with a support surface, one of said driven wheels being dirigible, support wheels disposed laterally of the longitudinal axis of said body means and spaced from said dirigible driven wheel, and variable drive means for driving said driven wheels.

2. A vehicle as set forth in claim 1 wherein said drive means includes motor means in driving engagement with each of said driven wheels, power source means for providing motive energy to said motor means, and compensating means responsive to the increase in resistance to motion of one of said motor means occasioned by a difference in the respective rotational speeds of said driven wheels for directing at least a portion of the motive energy away from said motor means of said slower driven wheel.

3. A vehicle as set forth in claim 2 wherein the motive energy directed away from said motor means of said slower driven wheel is directed to said motor means of said faster driven wheel.

4. A vehicle as set forth in claim 2 including attachment means for attaching said non-dirigible driven wheel to said body means, said attachment means being pivotally connected to said body means for permitting vertical movement of said wheel and including shock absorbing suspension means.

5. A vehicle as set forth in claim 4 wherein said attachment means includes a pair of spaced-apart arm members pivotally connected to said body means and an axle member supported between said arm members.

6. A vehicle as set forth in claim 5 wherein said suspension means includes a frame member disposed over said nondirigible driven wheel and supported by said arm members, and resilient means disposed between said frame member and said body means.

7. A vehicle as set forth in claim 6 including attachment means for attaching said dirigible driven wheel to said body means, said attachment means including a rotatable, generally vertical shaft member; a yoke member secured to the lower end of said shaft member; and an axle member supported by said yoke member.

8. A vehicle as set forth in claim 7 including means for controlling said dirigible driven wheel.

9. A vehicle as set forth in claim 8 wherein said dirigible driven wheel is dirigibly supported adjacent the front end of said body means.

10. A vehicle as set forth in claim 9 wherein one of said support wheels is disposed on each side of said nondirigible driven wheel and spaced laterally therefrom.

11. A vehicle as set forth in claim 10 wherein said body means includes means for attaching said support wheels thereto, said means including a pair of depending leg members and an axle member supported by each of said depending leg members.

12. A vehicle as set forth in claim 11 wherein said drive means includes a fluid motor in driving engagement with each of said driven wheels, fluid pump means for supplying motive fluid to said fluid motors, and valve means responsive to the pressure increase occasioned by a difference in the respective rotational speeds of said driven wheels for directing at least a portion of the motive fluid away from said fluid motor of said slower driven wheel.

13. A driven vehicle comprising: body means; a pair of driven wheels disposed in spaced-apart relationship along the longitudinal axis of said body means, one of said driven wheels being dirigible; a pair of axially aligned support wheels spaced longitudinally from said dirigible driven wheel; and drive means for driving said driven wheels, said drive means including a fluid motor in driving engagement with each of said driven wheels, fluid conducting means connecting said fluid motors in series for conducting a motive fluid thereto, fluid pump means for supplying a motive fluid to said fluid motors through said fluid conducting means, and valve means responsive to the pressure increase occasioned by a difference in the respective rotational speeds of said driven wheels for directing a portion of the fluid away from said fluid motor of the slower wheel.

14. A vehicle as set forth in claim 13 wherein said body means includes reservoir means for storing and distributing a fluid.

15. A vehicle as set forth in claim 13 including attachment means for attaching said non-dirigible driven wheels to said body means, said attachment means being pivotally connected to said body means for permitting vertical movement of said wheel and including shock absorbing suspension means.

16. A vehicle as set forth in claim 15 wherein said attachment means includes a pair of spaced-apart arm members pivotally connected to said body means and an axle member supported between said arm members.

17. A vehicle as set forth in claim 16 wherein said suspension means includes a frame member disposed over said nondirigible driven wheel and supported by said arm members, and resilient means disposed between said frame member and said body means.

18. A vehicle as set forth in claim 17 including attachment means for attaching said dirigible driven wheel to said body means, said attachment means including a rotatable, generally vertical shaft member; a yoke member secured to the lower end of said shaft member; and an axle member supported by said yoke member.

19. A vehicle as set forth in claim 18 including means for controlling said dirigible driven wheel.

20. A vehicle as set forth in claim 19 wherein said dirigible driven wheel is dirigibly supported adjacent the front end of said body means.

21. A vehicle as set forth in claim 20 wherein one of said support wheels is disposed on each side of said non-dirigible driven wheel and spaced laterally therefrom.

22. A vehicle as set forth in claim 21 wherein said body means includes means for attaching said support wheels thereto, said means including a pair of depending leg members and an axle member supported by each of said depending leg members.

23. A driven vehicle comprising: body means; two driven wheels disposed in spaced-apart relationship along the longitudinal axis of said body means and adapted for continuous engagement with a support surface, one of said driven wheels being dirigible, and drive means for driving said driven wheels, said drive means being variable and adapted to automatically compensate for differences in the rotational speed of said driven wheels, said drive means including a fluid motor in driving engagement with each of said driven wheels, fluid pump means for supplying a motive fluid to said fluid motors, fluid conducting means connecting said fluid motors in series for conducting the motive fluid thereto from said fluid pump means, and valve means responsive to the fluid pressure increase between said fluid motors occasioned by a difference in respective rotational speeds of said driven wheels for directing at least a portion of the motive fluid away from said fluid motor of said slower driven wheel.

* * * * *